United States Patent [19]

Felix

[11] 4,102,296

[45] Jul. 25, 1978

[54] MARINE SAFETY SIGNAL DEVICE

[76] Inventor: Harold E. Felix, 16142 Mariner Dr., Huntington Beach, Calif. 92649

[21] Appl. No.: 778,044

[22] Filed: Mar. 16, 1977

[51] Int. Cl.[2] ..... B63B 45/00; G09F 9/00

[52] U.S. Cl. ..... 116/124 B; 9/9

[58] Field of Search ..... 116/124 B, DIG. 9; 222/5; 46/87; 9/9

[56] References Cited

U.S. PATENT DOCUMENTS

| | | | |
|---|---|---|---|
| 1,858,460 | 5/1932 | Ranseen | 46/87 |
| 3,194,436 | 7/1965 | Jaynes | 222/5 |
| 3,266,668 | 8/1966 | Davis | 116/124 B |
| 3,279,419 | 10/1966 | Demarco | 116/124 B |
| 3,494,506 | 2/1970 | Fujimoto | 222/5 |
| 3,657,752 | 4/1972 | Davidson | 9/9 |
| 3,721,983 | 3/1973 | Sherer | 116/124 B X |
| 3,941,079 | 3/1976 | McNeill | 116/124 B |

*Primary Examiner*—Daniel M. Yasich

*Attorney, Agent, or Firm*—Robert D. Farkas

[57] ABSTRACT

A marine safety signal device includes an elongated line member, wherein one end of the line member is secured to a boat. A radar detectable element and a balloon element are secured to the other end of the line member. A mechanism is included for inflating the balloon element with a gas which is lighter than air.

1 Claim, 3 Drawing Figures

MARINE SAFETY SIGNAL DEVICE

BACKGROUND OF THE INVENTION

A number of U.S. Patents relate to variously designed safety signal devices, but these devices are non-related to the marine safety signal device of my present instant invention. These U.S. Patents are: Nos. 2,151,336 to Scharlau; 3,002,490 to Murray; 3,279,419 to Demarco and 3,381,655 to Rozzelle.

SUMMARY OF THE INVENTION

My present invention relates to a unique and novel marine safety signal device.

An object of my present invention is to provide a marine safety signal device for detection of a boat in distress.

A further object of my present invention is to provide a unique and novel means for inflating the balloon element of the device.

A marine safety signal device includes an elongated line member, wherein one end of the line member is secured to a boat. A radar detectable element and a balloon element are secured to the other end of the line member. A mechanism is included for inflating the balloon element with a gas which is lighter than air.

BRIEF DESCRIPTION OF THE DRAWINGS

The objects and features of the invention may be understood with reference to the following detailed description of an illustrative embodiment of the invention, taken together with the accompanying drawings in which.

DETAILED DESCRIPTION OF THE PREFERRED EMBODIMENT

Figure 1:
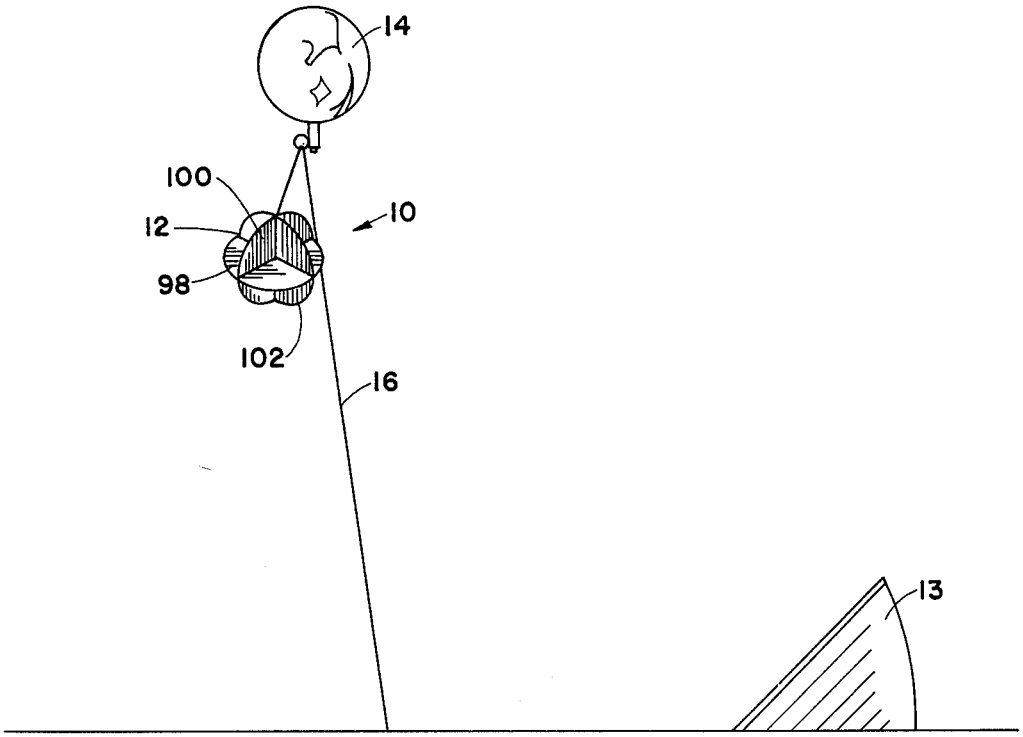
FIG. 1 illustrates a perspective view of a marine safety signal device.
Figure 2:
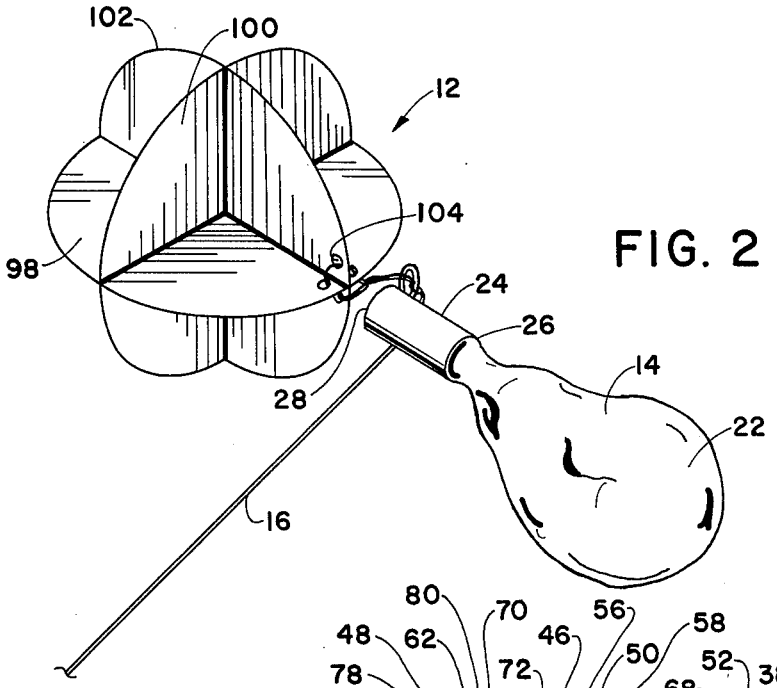
FIG. 2 illustrates an exploded perspective view of a balloon element and a radar detectable element of the device.
Figure 3:
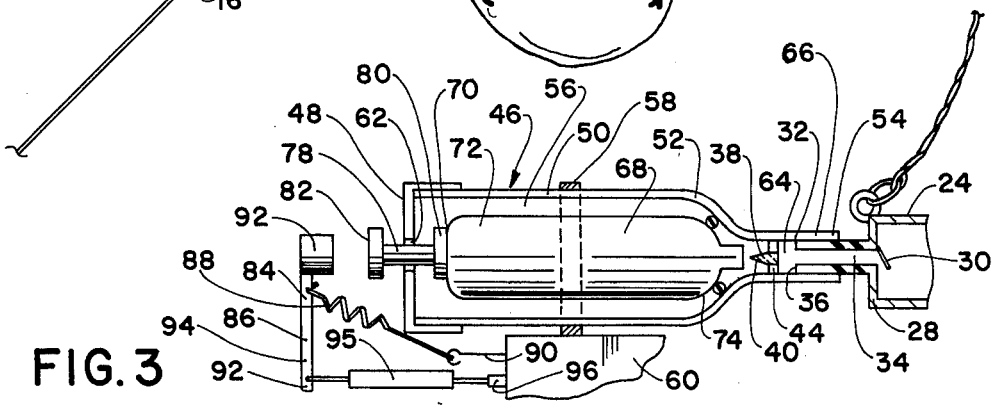
FIG. 3 illustrates a side cross sectional view of a gas injecting assembly of the device.

FIGS. 1–3 show a marine safety signal device 10 adapted to emit a visible as well as radar detectable element 12, which generally comprises the radar detectable element 12 and a balloon element 14 affixed to one end of a elongated line member 16, wherein the other end of the line member 16 is tied to an eye bolt anchored to a boat 13, and a gas injecting assembly 20 for inflating the balloon element 14.

The balloon element 14 generally includes an inflatable bladder portion 22 joined into an open end 26 of a cylindrically shaped sleeve 24 also having a closed end 28 with a one way check valve 30 disposed therein. A cylindrically shaped tubular element 32 is affixed to end 28 around valve 30 and extends linearly outwardly from end 28, wherein element 32 has a continuous bore 34 therethrough and an open free end 36. A needle like piercing element 38 is disposed in bore 34 and the pointed end 40 of element 38 extends outwardly from the free open end 36 of element 32. The needle like piercing element 38 is anchored within bore 34 by radially extending arms 44 affixed to an inner surface of element 32. A bottle shaped housing 46 having a base 48, an upwardly extending cylindrically shaped sidewall 50, a neck portion 52 with an open end 54, and a chamber 56 therein is secured by a strap clamp 58 to the boat 60, wherein the base 48 has a center opening 62 therethrough and the free end 36 of element 32 inserts into the bore 64 of neck 52 and is adhesively sealed to the inner surface of neck 52 by a water sensitive adhesive layer 66 which is also deposited on the free end 36 of element 32. A gas cylinder 68 is deposited in chamber 56, wherein cylinder 68 has a base 70, an upwardly extending sidewall 72, and an open neck portion 74 with a piercable valve 76 disposed in the neck portion 74. A means is provided for pushing the gas cylinder 68 forwardly within the chamber 56, wherein the pointed end 40 of element 38 pierces valve 76 as the outer end of neck portion 74 is adhesively secured to the outer end 36 of element 32. The pushing means includes a cylindrically shaped rod element 78 slidably disposed through opening 62 of base 48, wherein a pair of disc shaped elements 80, 82 are affixed to the ends of rod element 78, one element 80 disposed in said chamber 56 and the other element 82 is disposed externally to housing 46. A spring load hammer arm 84 is pivotally mounted in a bracket element 86 secured to the boat 13. A spring element 88 communicates between the arm 84 and a eye bolt element 90 secured to the boat 60. The head 92 of hammer arm 84 is aligned to hit against disc element 82 to hit element 82 to push disc element 80 against gas cylinder 68. The handle end 92 of hammer arm 94 is secured to one end of a rod 95 of "RADEL" thermoplastic which is water soluble, wherein the other end of the rod 95 is secured into a sleeve clamp 96 mounted on the boat 60.

When the boat 60 sinks, the rod 95 is dissolved by the water releasing the cocked hammer arm 84 to be released whereby the head 92 hits against the disc 82. When the balloon element 14 is inflated, the element 32 is pulled outwardly from the neck 52 as the water sensitive adhesive layer 66 dissolves. The radar detectable element 12 includes three perpendicularly intersecting planar elements 98, 100, 102 formed from highly reflective metallic materials, wherein the one end of line member 16 is tied through a hole 104 in one of elements 98, 100, 102. The end of line member 16 is also tied to a eye bolt member 108 mounted on sleeve 24.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A marine safety signal device, which comprises an elongated line member, one end of said line member secured to a boat, a balloon element secured to another end of said line element, said balloon element including an inflatable bladder portion, a cylindrically shaped sleeve having an open end and a closed end, said bladder portion secured into said open end of said sleeve, a one way check valve element disposed in said closed end of said sleeve, a cylindrically shaped tubular element, one end of said tubular element affixed onto said closed end of said sleeve around said valve, a radar detectable element formed from three perpendicularly intersecting metallic reflecting elements having holes therethrough, said other end of said line member tied through one of said holes, means for inflating said balloon element including a bottle shaped housing having a base with a center opening therethrough, an upwardly extending sidewall and a neck portion, said tubularly shaped element sealed by a water and pressure sensitive adhesive within said neck portion, a needle like piercing element disposed in said cylindrically shaped element and extending outwardly from a free end of said tubular element, a gas cylinder having a base and an upwardly extending sidewall and a neck portion disposed in a chamber of said bottle shaped housing, said gas cylinder having a gas lighter than air disposed therein, a piercable valve element disposed in said neck of said gas valve, means for pushing said gas cylinder forwardly within said bottle shaped housing whereby said piercing element pierces said piercing valve, wherein said pushing means includes a cylindrically shaped rod slidably disposed through said center opening of said base of said bottle shaped housing, a first disc element affixed to one end of said rod within said chamber, said first disc element hitting against said base of said gas cylinder, a second disc element affixed to another end of said rod externally to said bottle shaped housing, means for hitting said disc element having a hammer arm, said hammer arm pivotally mounted in a bracket secured to said boat, said hammer arm having a head at one end thereof, said head hitting against said second disc element, a spring element, said spring element communicating between said boat and said hammer arm, means for maintaining said hammer arm in a cocked position including a water soluble thermoplastic rod, said water soluble rod secured between said boat and another end of said hammer arm, said rod dissolved by water to release said hammer arm from said cocked position.

* * * * *